US007370755B2

(12) United States Patent
Cuomo

(10) Patent No.: US 7,370,755 B2
(45) Date of Patent: May 13, 2008

(54) CARRIER AND METHOD

(75) Inventor: Angelo V. Cuomo, Staten Island, NY (US)

(73) Assignee: EZ Media, Inc., New York, NY (US)

( * ) Notice: Subject to any disclaimer, the term of this patent is extended or adjusted under 35 U.S.C. 154(b) by 569 days.

(21) Appl. No.: 11/012,789

(22) Filed: Dec. 15, 2004

(65) Prior Publication Data

US 2005/0092623 A1 May 5, 2005

Related U.S. Application Data

(63) Continuation-in-part of application No. 10/215,938, filed on Aug. 9, 2002, now Pat. No. 7,185,758, and a continuation-in-part of application No. 10/662,265, filed on Sep. 15, 2003, now Pat. No. 7,243,785, and a continuation-in-part of application No. 10/737,612, filed on Dec. 16, 2003, now Pat. No. 7,267,224, and a continuation-in-part of application No. 10/939,264, filed on Sep. 10, 2004.

(51) Int. Cl.
*B65D 75/00* (2006.01)

(52) U.S. Cl. ..... 206/162; 206/427; 206/549; 53/443; 53/474

(58) Field of Classification Search ..... 206/162, 206/167, 170, 175, 180, 427, 541, 549; 229/117, 229/117.14; 426/120, 129; 53/443, 445, 53/474

See application file for complete search history.

(56) References Cited

U.S. PATENT DOCUMENTS

| | | | |
|---|---|---|---|
| 952,302 | A | 3/1910 | Brenner |
| 962,607 | A | 6/1910 | Wood |
| 982,919 | A | 1/1911 | Wood |
| 1,223,202 | A | 4/1917 | Proctor |
| 2,026,525 | A | 1/1936 | Korte |
| 2,284,290 | A | 5/1942 | Marshall, Jr. |
| 2,319,380 | A | 5/1943 | Wells |
| 2,330,699 | A | 9/1943 | Flamm |
| 2,339,176 | A | 1/1944 | Lee |
| 2,373,851 | A | 4/1945 | Potter |
| 2,405,517 | A | 8/1946 | Plummer |
| 2,453,908 | A | 11/1948 | Harhay |
| 2,594,376 | A | 4/1952 | Arneson |
| 2,630,264 | A | 3/1953 | Holy |
| 2,759,629 | A | 8/1956 | Sargent |

(Continued)

*Primary Examiner*—David T. Fidei
(74) *Attorney, Agent, or Firm*—Krammer Levin Naftalis & Frankel LLP; Gregor N. Neff

(57) ABSTRACT

The carrier has beverage cup-holding receptacles on opposite sides of a vertical support panel, and a third much larger receptacle formed from the same blank. The carrier is stored flat and is unfolded for use at a usage location such as a motion picture theater concession stand, where it can be used to carry beverage cups in the smaller receptacles and a bucket of popcorn in the large receptacle. A tray can be mounted on an upright handle structure through a slot in the bottom, and can be used to carry other food item such as candy, hot dogs, etc. The carrier can be used to carry out fast foods such as fried chicken, french fries and beverages. Solid, bulky foods such as popcorn and fried chicken can be carried in the larger receptacle directly, without the use of a bucket or other separate container.

19 Claims, 5 Drawing Sheets

U.S. PATENT DOCUMENTS 2,828,047 A 3/1958 Weiselberg
2,850,223 A 9/1958 Strauss
2,991,908 A 7/1961 Conescu
3,123,213 A 3/1964 Kulig
3,140,036 A 7/1964 Spery
3,266,663 A 8/1966 Ringler
3,547,339 A 12/1970 Bruce
3,565,323 A 2/1971 Katzenmeyer
3,576,274 A 4/1971 Stramaglia
3,661,417 A 5/1972 Inman
3,744,704 A 7/1973 Struble
3,780,906 A 12/1973 Katzenmeyer
3,868,140 A 2/1975 Gordon
3,958,744 A 5/1976 Herglotz
4,047,610 A 9/1977 Stout et al.
4,053,099 A 10/1977 Lock
4,089,457 A 5/1978 Wood et al.
4,155,502 A 5/1979 Forte
4,205,748 A 6/1980 Wilson
4,406,365 A 9/1983 Kulig
4,620,644 A 11/1986 Miller
4,744,613 A 5/1988 Brantingham
4,798,285 A 1/1989 Hernandez
4,852,731 A 8/1989 Cooper
4,895,256 A 1/1990 Johnston
4,927,009 A 5/1990 Stout
4,969,595 A 11/1990 Teasdale
5,052,552 A 10/1991 Maroszek
5,161,732 A * 11/1992 Clein et al. ..... 229/117
5,234,103 A 8/1993 Schuster
5,249,700 A 10/1993 Dumke
5,320,216 A 6/1994 Pangborn
5,332,091 A 7/1994 Gugler
5,337,947 A 8/1994 Eskandry
5,415,277 A 5/1995 Berntsen
5,423,420 A 6/1995 Bakx
D367,409 S 2/1996 Hunter
5,501,338 A 3/1996 Preston
5,524,814 A 6/1996 Davis
5,538,131 A * 7/1996 Harrelson ..... 206/162
5,609,379 A 3/1997 Harrelson
5,611,425 A 3/1997 Holley, Jr.
5,624,024 A 4/1997 Miess
5,645,162 A 7/1997 Harrelson
5,695,051 A 12/1997 Hart
5,709,298 A 1/1998 Harris
5,738,217 A 4/1998 Hunter
5,765,684 A 6/1998 Van Dore
5,788,081 A 8/1998 Bates
5,797,486 A 8/1998 Picciolo
5,803,264 A 9/1998 Gersten et al.
5,813,540 A 9/1998 Vollbrecht
5,816,405 A 10/1998 Carriger, Jr.
5,833,056 A 11/1998 Goldman
5,884,756 A 3/1999 Holley, Jr.
5,927,502 A 7/1999 Hunter
5,927,593 A 7/1999 Berkowitz
5,957,276 A 9/1999 Cutler
5,975,287 A 11/1999 Negelen
6,000,536 A 12/1999 Piotrowski
6,131,729 A 10/2000 Eckermann
6,168,013 B1 1/2001 Gomes
6,230,881 B1 5/2001 Collura
6,341,689 B1 1/2002 Jones
6,439,452 B1 * 8/2002 Tsao ..... 229/120.15
6,443,308 B1 * 9/2002 Davis ..... 206/549
6,598,739 B1 7/2003 Collura
6,832,687 B2 * 12/2004 Davis ..... 206/549
2002/0179459 A1 12/2002 Bakx
2003/0213705 A1 11/2003 Woog
2003/0230499 A1 * 12/2003 Wagner ..... 206/216
2004/0118707 A1 * 6/2004 Sutton-Rainey et al. .... 206/170

* cited by examiner

CARRIER AND METHOD

This patent application is a Continuation-in-Part of U.S. Ser. Nos. 10/215,938, filed Aug. 9, 2002 now U.S. Pat. No. 7,185,758; 10/662,265 filed, Sep. 15, 2003 now U.S. Pat. No. 7,243,785; 10,737,612, filed Dec. 16, 2003 now U.S. Pat No. 7,267,224 and 10/939,264 filed, Sep. 10, 2004. The disclosure of the foregoing patent applications hereby is incorporated herein by reference.

This invention relates to carriers and methods of using and manufacturing same, and particularly to carriers and methods for use in distributing food and beverages.

Even more particularly, the invention relates to carriers and methods for carrying a wide variety of objects of widely varying sizes in a single carrier.

In the prior above-identified patent applications, the carriers described there are adapted for hand-carrying beverages, solid food, and a variety of objects such as motor oil cans and similar objects. Although those carriers are highly desirable, the ability to carry containers of widely varying sizes is somewhat limited.

In particular, in many so-called "fast food" stores, movie theaters, etc., food and beverages are sold which are of relatively moderate size, along with much larger containers such as the so-called "buckets" containing popcorn, or fried chicken, or fried fish or shrimp, etc.

Accordingly, it is an object of the present invention to provide a carrier and distribution method in which both relatively small items, such as beverage containers and relatively large containers, such as "buckets" or comparable quantities of loose items of solid food can be carried in a single carrier.

It is another object to provide such a carrier in which smaller solid food items, such as hamburgers, hotdogs, sandwiches, candy bars and packages, etc., also can be carried, preferably separately from the other items.

It also is an object of the invention to provide such a carrier which is sturdy, relatively inexpensive to manufacture, easy to set up by food distribution personnel and/or customers, and relatively easy to carry, preferably with one hand.

In accordance with the present invention, the foregoing objects are satisfied by the provision of a carrier and method in which a vertical central support structure is provided, with a pair of foldable receptacles extending from opposite sides of the central support structure, when the carrier is unfolded, and a lateral extension which provides a third receptacle for carrying either a container of much larger diameter than those which can be carried in the two first mentioned containers, so as to hold "buckets" of popcorn, fried chicken, etc., or as a complete container for such foods, without the bucket.

In providing such a carrier, it is preferred that the basic carrier construction described in my prior patent applications be utilized, with modifications, to provide the carrier structure.

An open tray with a slot in the bottom, or a closed box with slots in both the top cover and the bottom can be used by slipping the tray or the box over the upright central support/handle structure so as to carry additional solid items such as hotdogs, hamburgers, boxes, bags or bars of candy or fruit, etc.

In one specific embodiment of the invention, retainer panels with one or two beverage-receiving holes are provided to fit over the tops of the smaller carrier receptacles so as to stabilize and hold the beverage containers and prevent them from slipping or tipping from side-to-side in the receptacles.

The foregoing and other objects and advantages of the invention will be apparent from or explained in the following description and drawings.

GENERAL DESCRIPTION

Figure 1:
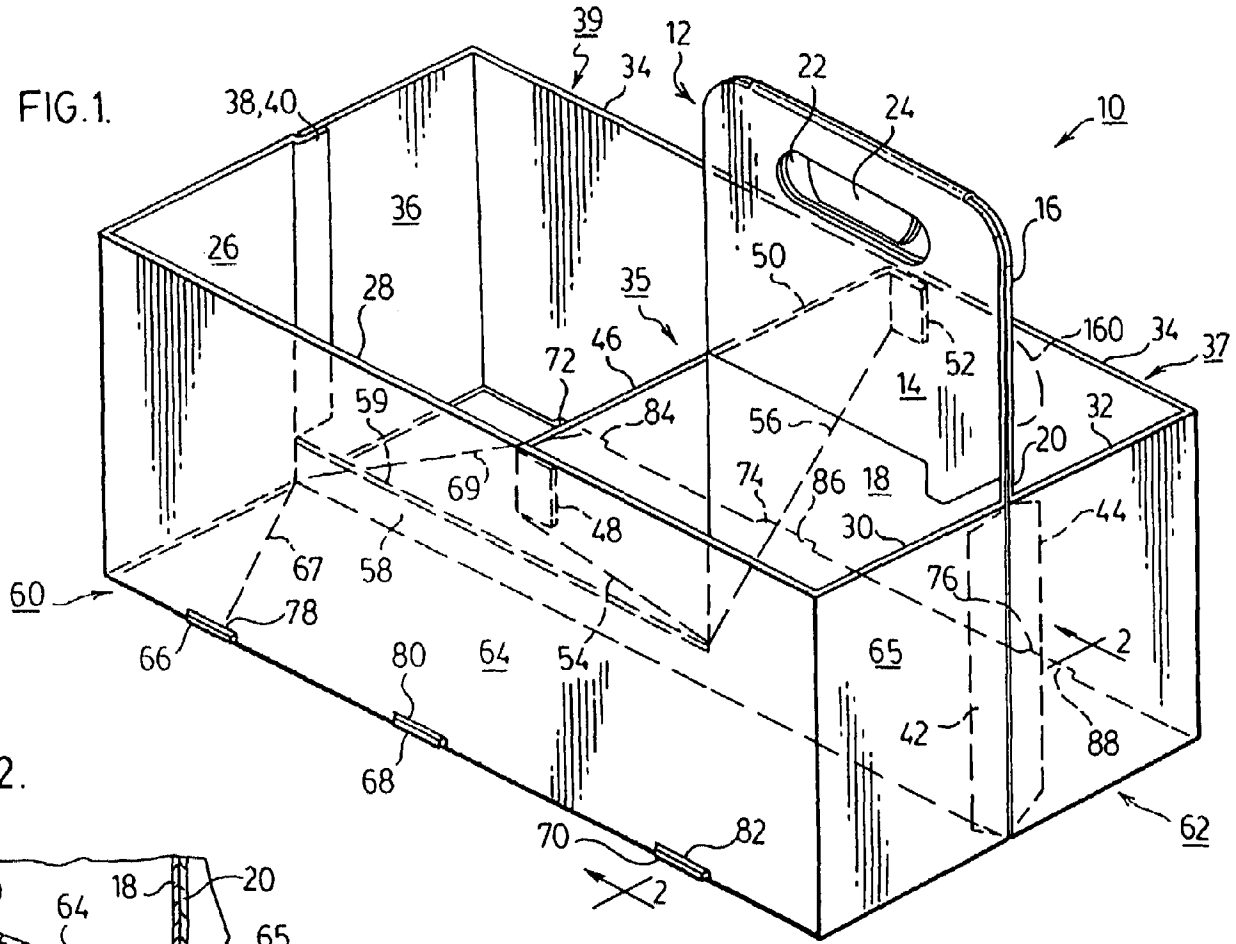
FIG. 1 is a perspective view of a carrier constructed in accordance with the present invention.

FIG. 1 shows a first embodiment 10 of the carrier of the present invention.

The carrier 10 includes a vertical support structure 12. Two foldable receptacle structures 35 and 37 are secured to and extend from the vertical support structure 12 when the carrier is unfolded.

One receptacle structure 35 includes side walls 26, 28 and 30, and the second receptacle structure 37 includes vertical side walls 32, 34 and 36. Flaps 42 and 44 extend from the vertical support structure 12 and are glued to the inside surfaces of panels 30 and 32, respectively. Foldable bottom structures 60 and 62 extend from the bottom walls of the receptacle structures.

Dividers 46 and 50 extend from the vertical support structure 12 to the opposite side walls 28 and 34 and are glued thereto by means of tabs 48 and 52, respectively. The dividers 46 and 50 are positioned relatively close to the ends 30 and 32 50 that the receptacles 35 and 37 are relatively small. The walls 28, 34 and bottom structure 60, 62 extend laterally from the dividers by a relatively greater distance to form a third much larger compartment or receptacle 39 to the side of each receptacle.

CENTRAL SUPPORT STRUCTURE

The central support structure 12 includes a pair of relatively tall vertical panels 18 and 20 which are glued together back-to-back. A four-ply handle portion is formed by panels 14 and 16, which are glued, respectively, to the upper portions of panels 18 and 20. A handle hole 22 is provided near the upper edge of the structure 12, with a folding finger guard structure 24.

It should be understood, of course, that equivalent structures can be made utilizing only a two-ply or one-ply vertical support structure, depending upon the weight of the fiberboard used, expected loads to be carried, etc.

The large receptacle 39 formed by the lateral extension of the side walls 34 and 28 and the bottom walls 60 and 62 is strengthened by extending the panels 18 and 16 at their lower edges to form extensions 58 and 59, which are glued together to form a stiff, short vertical spine at the bottom of the large receptacle 39. Flaps 38 and 40, extending from the leftmost edges of the panels 26 and 36, respectively, are glued together, folded over and glued to the panel 36, as shown.

BOTTOM STRUCTURES

Figure 2:
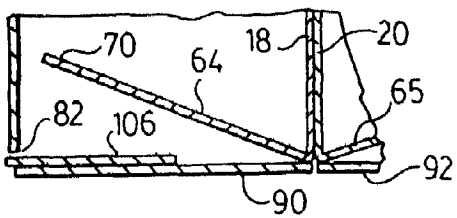
FIG. 2 is a cross-sectional, broken away view taken along line 2-2 of FIG. 1.
Figure 3:
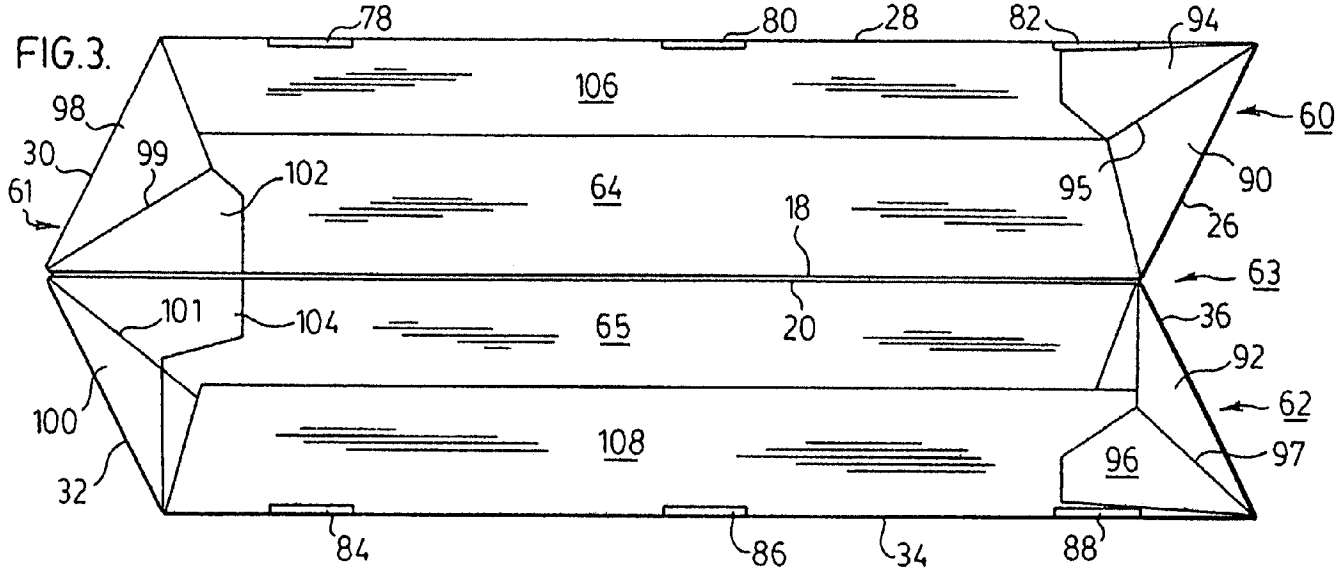
FIG. 3 is a bottom plan view of the carrier shown in FIG. 1, with the carrier partially unfolded.
Figure 6:
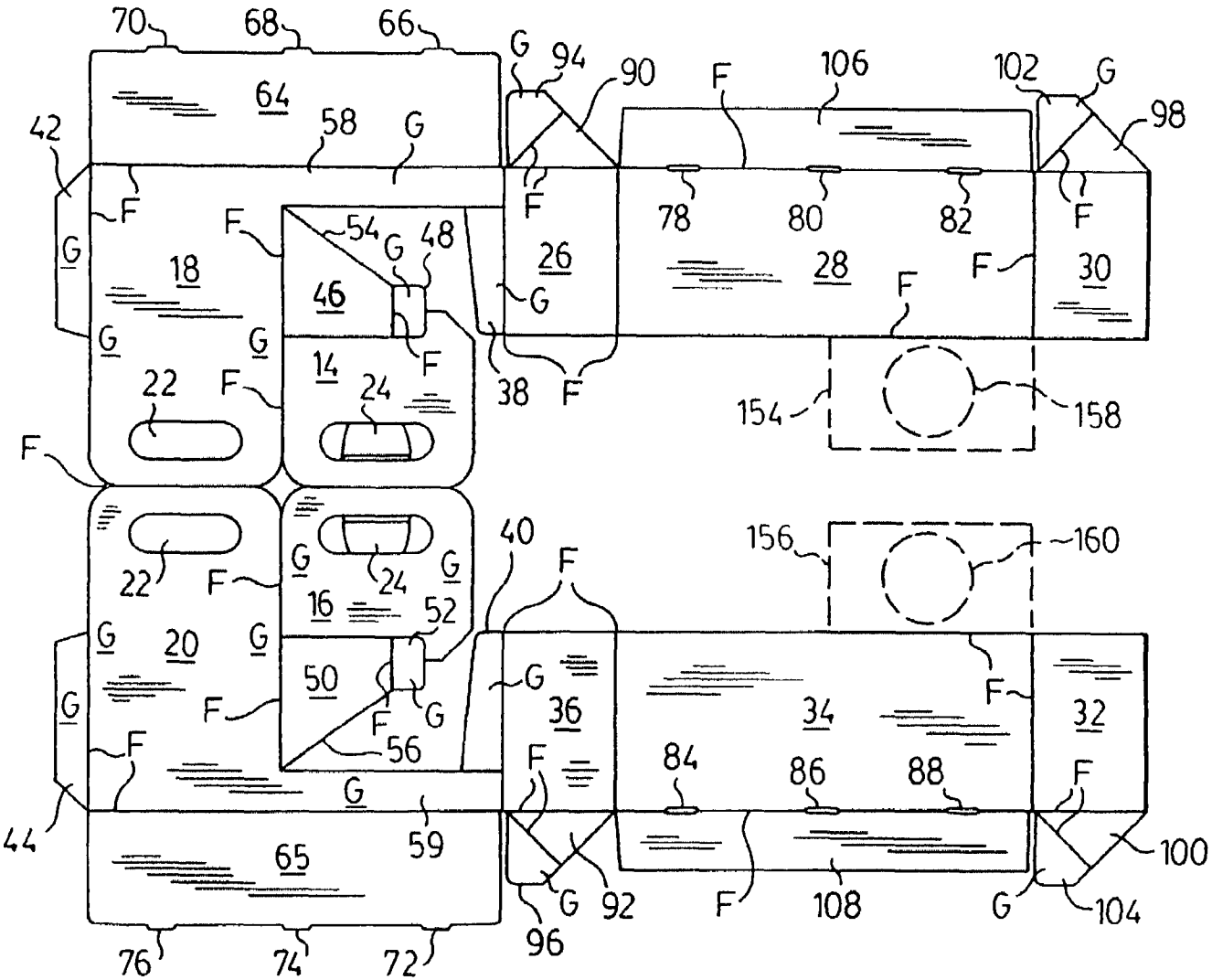
FIG. 6 shows a fiberboard blank used to make the carrier of FIGS. 1-4.

The bottom structures 60 and 62 are illustrated in FIGS. 1, 2 and 3, as well as in FIG. 6.

Each bottom structure 60 or 62 includes a broad top flange or panel 64 or 65 hinged at one edge to the panel 18 or 16 and the spine formed by panel portions 58 and 59.

As in prior embodiments of the carriers shown in the above-identified pending patent applications, the panels 64 and 65 advantageously extend completely across the bottom of the receptacles they form. Each panel has three short projections 66, 68 and 70 or 72, 74 and 76, which fit through slots 78, 80 and 82 or 84, 86 and 88 when the panels 64 and 65 are completely unfolded and pressed downwardly by use of hand pressure, or by the pressure of beverage containers resting on the panels.

The bottom structures 60 and 62 are very much the same as the bottom structure shown in my above-identified pending patent applications in that they open automatically when the folded ends of the folded carrier are pushed towards one another (in the directions indicated by the arrows 61 and 63 in FIG. 3) so that the structure forms a strong platform to support the top panel 64 or 65 and objects in the receptacles.

As it is shown in FIGS. 2 and 3, at the rear corner of the receptacle 35 is a flange or flap 90 with a tab 94 which is secured to a long flange 106 and which has a diagonal fold line 95. Similarly, at the front of the carrier, a flap 98 extends from the wall 30 with a tab 102 which is glued to the undersurface of the panel 64. The flap 98 folds along a diagonal line 99.

Similarly, the bottom structure 62 includes a flap or flange 92 hinged to the bottom edge of panel 36. The flange 92 has a tab 96 which is glued to a flange 108. The flange 92 has a diagonal fold line at 97.

Finally, at the front of structure 62, a flange 100 with a tab 104 is hinged to the wall 32. The tab 104 is glued to the panel 65 and has a diagonal fold line 101.

Please delete the paragraph starting on page 8, line 18, and replace it with the following paragraph:

Referring again to FIG. 1, as well as to FIG. 6, it can be seen that the panels 64 and 65 are basically rectangular in shape. The rectangular shape has a beneficial aspect in that, when the flanges 64 and 65 are pulled downwardly by the corner tabs, the flanges tend to fill the space between the front and back walls of the receptacles 35 and 37 so that, once the carrier is unfolded by pressing on the folded ends of the carrier, the carrier will stay open when resting upon a horizontal surface so as to facilitate filling it with items to be carried in the carrier.

When the carrier is folded flat, the rear corners of the panels 64 and 65 are folded downwardly along the fold lines 67 and 69, respectively, due to engagement with the panels 26 and 36. As the carrier is opened and the panels 64 and 65 are pressed downwardly, the corners of the panels press against the panels 26 and 36 and, when the tabs along the edges of the panels 64 and 65 fit into the mating slots, the carrier is held fully open. Advantageously, the seating of the tabs in the slots can be performed simply by placing beverages in the beverage receptacles so that the weight of the beverages will press downwardly on the panels and properly seat them.

It should be noted that the bottom edges 54 and 56 of the dividers 46 and 50 are cut at an upward angle as shown, in order to prevent interference between the panels 64 and 65 and the dividers as the carrier is being unfolded.

FOOD DISTRIBUTION

Figure 4:
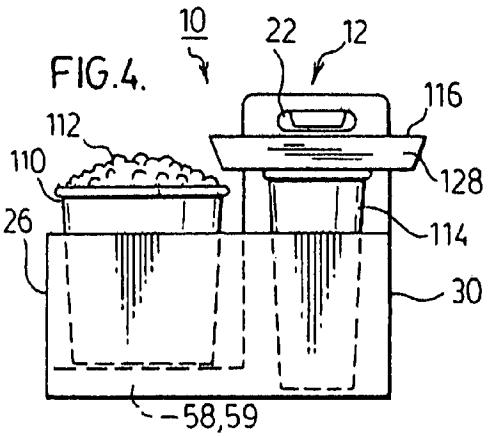
FIG. 4 is a partially schematic side elevation view of the carrier of FIG. 1 containing a bucket, beverage containers and a tray, as used in accordance with one embodiment of the present invention.

FIG. 4 illustrates the use of the carrier 10 in a typical food distribution process.

Assume, as an example, that the carrier 10 is being used in a movie theater selling beverages in cups 114, "buckets" 110 filled with popcorn 112, and candy bars, in boxes or bags.

First, the carrier blank is opened by pressing on the ends of the blank in the directions 61, 63 (FIG. 3), the beverages 114 are put in the receptacles 35 and 37, a bucket 110 of popcorn 112 is placed in the larger container 39 as shown in FIG. 4, with the bottom of the bucket resting on the vertical spine 58, 59. The popcorn is very light-weight and is mostly balanced by the weight of the beverages 114 so that it is relatively easy to carry the popcorn and the beverages with one hand by using the handle 22.

If the customer purchases bags, boxes or bars of candy, or other solid foods such as hot dogs, these can be placed in a tray 116 which slips onto the upper portion of the vertical support structure 12. Thus, the customer can carry, in one hand, beverages, a large container of popcorn, and candy, etc., in the tray. Most of the weight is centered directly underneath the handle.

If the bucket 110 holds a relatively heavy substance such as fried chicken or shrimp at 112 instead of the lighter-weight popcorn, it might be desirable to help support the left portion of the carrier with the other hand.

Figure 5:
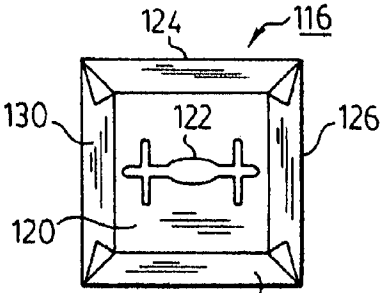
FIG. 5 is a top plan view of a tray used in the embodiment shown in FIG. 4.

FIG. 5 is a top plan view of the tray 116, which is shown in greater detail in several of the above-identified co-pending patent applications. The tray 116 has a bottom wall 120 with an elongated slot 122 through which the vertical support structure 12 fits. It has four side walls 124, 126, 128 and 130 which are angled upwardly as shown, with the sides being glued together at the corners.

If preferred, a closed food box can be used instead of the open tray 116, as is described in my co-pending application Ser. No. 10/939,264 filed Sep. 10, 2004, and as further described hereinbelow The closed container can contain donuts, bagels, pizza, or other comestibles, which can be heated in the box prior to the box being attached to the carrier.

Smaller beverage cups might not fill the receptacles 35 and 37. For that and other reasons, it may be desired to provide means for holding the beverage cups stable against tipping or sliding sideways.

This can be performed, in accordance with another feature of the invention, by adding flaps 154 and 156, shown in dashed outline in FIG. 6, which fold over the top of the beverage compartments and have holes 158 and 160, respectively, to embrace a semi-cylindrical beverage cup and hold it steady.

The use of this feature is illustrated schematically in FIG. 1 where the beverage retainer hole 160 is shown in dashed outline. Preferably, the dimensions of the panels 154 and 156 are such as to cause them to rest on the upper edges of the side walls of the receptacles.

CARRIER-FORMING BLANK

FIG. 6 shows a blank for the carrier 10. The blank is formed advantageously from a single sheet of fiberboard material. Fold-lines are marked with the letter "F", and areas to which glue is applied are marked with the letter "G".

The carrier can be manufactured with a single die cutting step from a single sheet of material, with folding and gluing steps following thereafter.

The carrier can be manufactured in relatively high volume at a relatively modest cost.

PREFERRED EMBODIMENT

Figure 8:
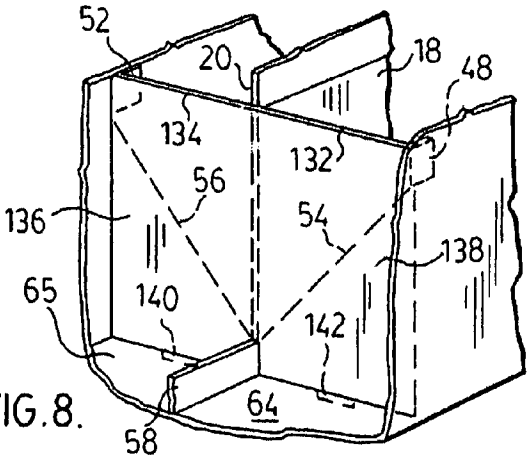
FIG. 8 is a perspective, partially broken away, and partially schematic cross-sectional view taken along line 8-8 of FIG. 7.
Figure 7:
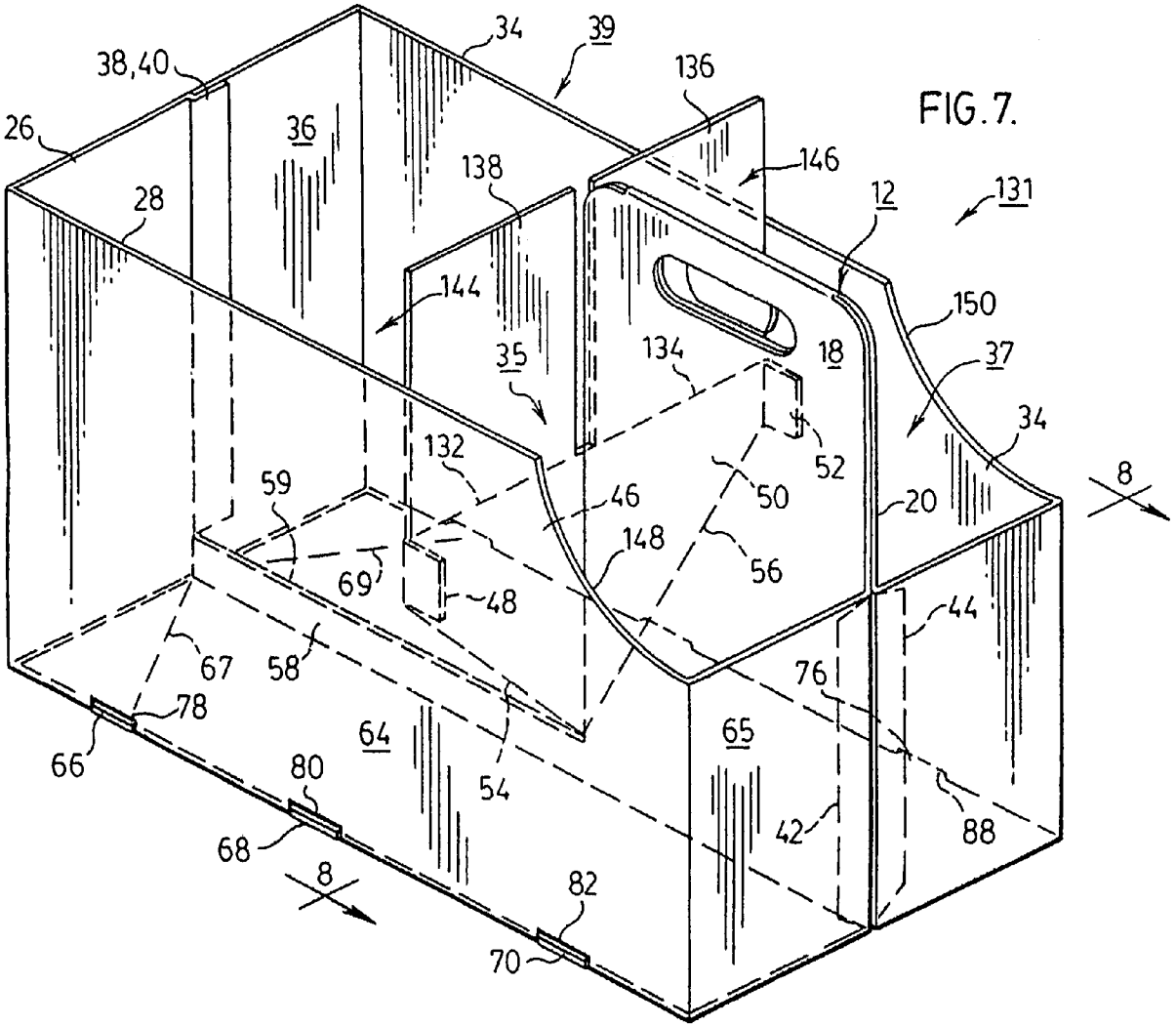
FIG. 7 is a perspective view of another embodiment of the carrier of the invention.
Figure 9:
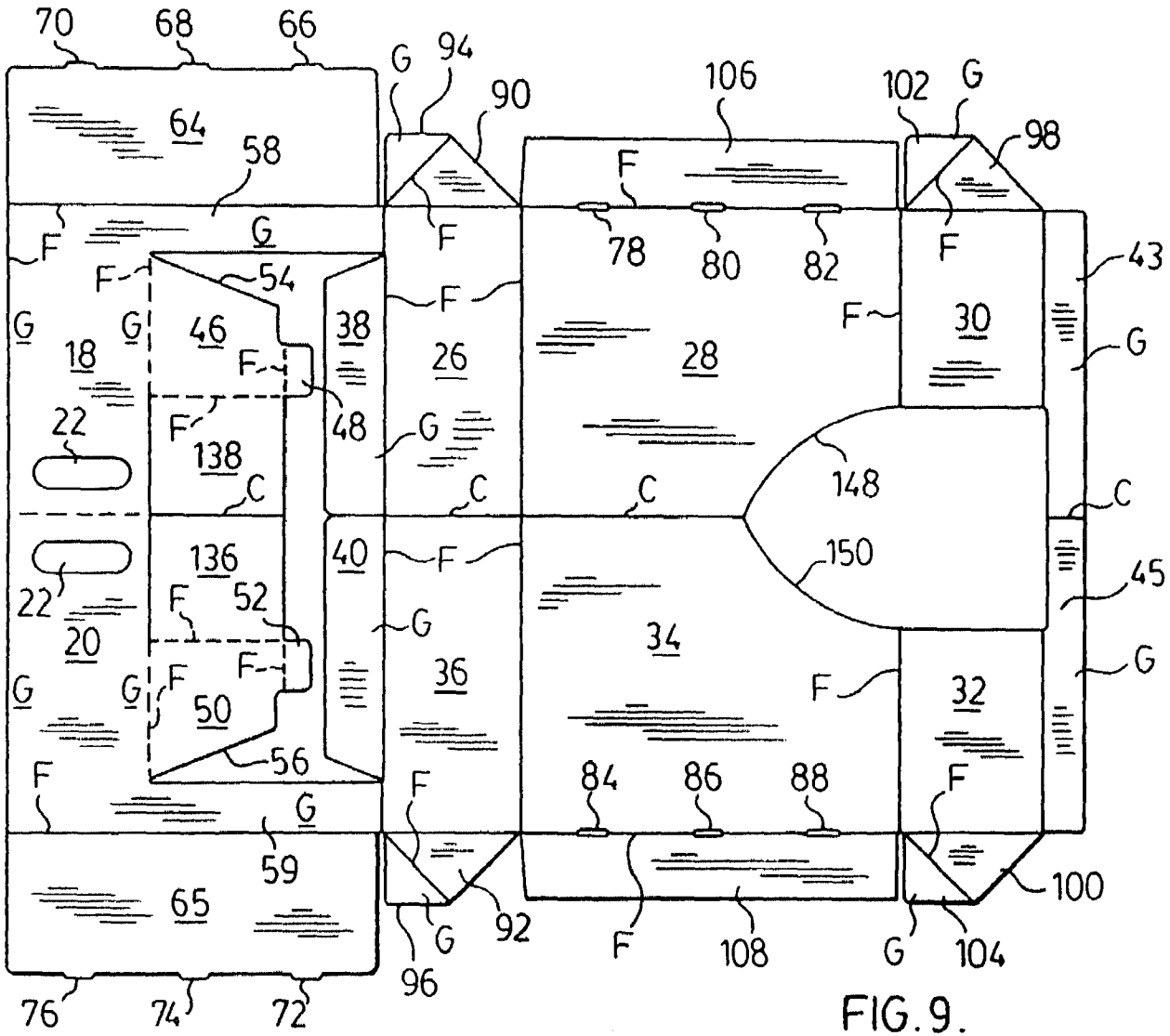
FIG. 9 is a top plan view of a blank used to make the carrier of FIGS. 7 and 8.

FIGS. 7-9 show the preferred carrier 131 of the invention. This carrier 131 is substantially the same as the carrier shown in FIGS. 1-6, with certain variations. Accordingly, the same reference numerals have been used for the parts of the carrier 131 corresponding to parts of the carrier 10 shown in FIGS. 1-6.

One of the differences between the carrier 131 shown in FIGS. 7-9 and that shown in FIGS. 1-6 is that the rear portions of the vertical side walls 26, 28, 34 and 36 are considerably taller than the corresponding walls of the first-disclosed carrier. The taller walls are given a curved cut at 148 or 150 to reduce their height at the front end of the carrier to provide ready access to the receptacles 35 and 37.

Another change in the carrier 131 is the provision of two foldable sealing panels 136 and 138 for sealing the large receptacle 39 from the smaller receptacles 35 and 37 to enable popcorn, fried chicken or other particulate items to be carried in the large container 39 without a bucket and without leaking those items into the smaller receptacles.

Each panel 136 and 138 is hinged along a fold line 134 or 132 so that it can be folded downwardly to the position shown in the directions indicated by arrows 144 and 146, in FIG. 7, in which it forms a vertical wall closing the space below the lower edge 54 or 56 of the divider 46 or 50 to seal the large receptacle from the smaller ones.

Optionally, tabs 140 and 142 (FIG. 8) can be provided at the edges of the panels 136 and 138 to mate with properly located slots in the bottom structure of the carrier to lock the security panels 136 and 138 into place. Alternatively, the locking function can be performed simply by insuring a frictional engagement between the lower edge of each panel 136 and 138 and the corresponding bottom structure of the receptacle in which it is located.

When the carrier 131 is being unfolded, after the ends of the folded carrier have been pressed towards one another, the panels 136 and 138 are bent downwardly. This has the advantage of pressing the upper panels of the bottom structures downwardly so as to lock them in position.

With this change, the large receptacle 39 can be used to hold popcorn, fried chicken, or other particulate foods such as french fries, etc., directly, without the use of "buckets". This is highly desirable as a cost-saving feature.

FIG. 9 shows a blank for a carrier substantially like that shown in FIGS. 7 and 8, except that it is of a size to hold only two beverage cups in the receptacles 35 and 37. In other words, the blank shown in FIG. 9 would be somewhat longer for a four-cup carrier.

As before, fold lines are marked with the letter "F", and areas to be glued are marked with the letter "G". In addition, some of the cut lines are marked with the letter "C".

One of the differences between the blanks shown in FIG. 9 and the carrier shown in FIG. 1-6 is that the flaps 43 and 45 which are used to secure the side walls to the vertical support panels extend from the right end of the panels 30 and 32, instead of flaps 42 and 44, which extend from the left end of the vertical support panels 18, 20 in the FIG. 1-6 structure.

In addition, it should be understood that one of the flaps 38 and 40 may be omitted, if desired, so that the joint at the rear wall of the carrier is formed by a single flap glued to the vertical side wall.

It can be seen that the material for the security panels 136 and 138 is taken from the material which forms the third and fourth plies of the handle structure shown in FIG. 1. Thus, the handle structure of the embodiment shown in FIGS. 7-9 is only two-ply instead of four. However, this is not believed to be a substantial disadvantage.

FIG. 9 shows the main reason for the extended height of the walls 26, 28 and 34. They are extended to a height such that the side wall material extends to the cut line "C" in the center of FIG. 9. This greatly facilitates the automatic formation of the carrier in modern fabrication equipment.

MATERIALS

The materials of which the carrier 10 can be made will vary depending upon the intended use of the carrier. Normally, relatively low cost materials such as untreated fiberboard will be sufficient. SUS water-resistant coated board can be used to provide additional resistance to weakening due to spilled liquids. If the container is to be used to hold foods such as popcorn or fried chicken, which are laden with cooking oil or other oily substances, the board materials can be selected to be resistant to absorption or "bleed-through" of such substances.

The above description of the invention is intended to be illustrative and not limiting. Various changes or modifications in the embodiments described may occur to those skilled in the art. These can be made without departing from the spirit or scope of the invention.

What is claimed is:

1. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, said side wall panels including two sets of panels, each comprising three panels secured together in series along fold lines, each set being secured at its ends to said vertical support panel structure, each of said panels having an upper and a lower edge, an automatically-opening bottom structure comprising selectively interconnected flanges extending from said lower edge of each of said panels for each of said two sets of panels, said side wall panels forming side walls of said first, second and third receptacles, said bottom structures forming bottom walls for said first, second and third receptacles, said vertical support panel structure being of much greater height adjacent said hand hold structure than laterally thereof to give said third receptacle twice the width of said first and second receptacles.

2. A carrier as in claim 1 in which each of said first and second receptacles includes a divider wall separating it from said third receptacle.

3. A carrier as in claim 1 including a further receptacle with means for mounting it on said vertical support panel structure above said first and second receptacles.

4. A carrier as in claim 1 in which said third receptacle is substantially larger than either of said first and second receptacles.

5. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, in which each of said first and second receptacles includes a divider wall separating it from said third receptacle, and in which each of said receptacle structures includes a bottom structure having a foldable top wall comprising a broad panel extending, when unfolded, substantially across said bottom structure in said first direction, and substantially across said bottom structure in a second direction perpendicular to said first direction, and the lower edge of each of said divider walls is located upwardly from said bottom structure to provide clearance for unfolding of said top wall when said bottom structure is being unfolded.

6. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, in which each of said first and second receptacles includes a divider wall separating it from said third receptacle, and in which each of said receptacle structures includes a bottom structure having a foldable top wall, each of said top walls comprising a broad top panel extending, when unfolded, substantially across said bottom structure in said first direction and extending substantially across said bottom structure in a direction perpendicular to said first direction, and including a sealing panel for each of said first and second receptacles, each of said sealing panels being foldable into a position to form a barrier to prevent particulate materials from moving between said third receptacle and either of said first and second receptacles.

7. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, in which said vertical support structures comprises a pair of vertical panels secured together back-to-back, said vertical support panels being of much greater height in the vicinity of said first and second receptacles than in the vicinity of said third receptacle to form a short vertical spine for said third receptacle.

8. A carrier as in claim 7 in which said carrier has a side wall formed by a pair of panels joined together by a pair of flanges secured together at a position aligned with said spine.

9. A carrier as in claim 3 in which said further receptacle is a tray which has a bottom wall with a slot in it through which said vertical panel structure can extend.

10. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, in which said carrier includes a foldable panel forming a bottom support member which is shaped and sized to bear against at least one of said side walls to hold said carrier open to facilitate loading said carrier.

11. A carrier comprising a vertical support panel structure having a hand-hold structure, first, second and third receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, including a cover over each of said first and second receptacles, said cover having a hole to support a container in said receptacle.

12. A carrier comprising a vertical support panel structure having a hand-hold structure, first, second and third foldable container structures secured to said vertical support panel structure and unfoldable to to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, said side wall panels including two sets of panels, each comprising three panels secured together in series along fold lines, each set being secured at its ends to said vertical support panel structure, each of said panels having an upper and a lower edge, an automatically-opening bottom structure comprising selectively interconnected flanges extending from said lower edge of each of said panels for each of said two sets of panels, said side wall panels forming side walls of said first, second and third receptacles, said bottom structures forming bottom walls for said first, second and third receptacles, said vertical support panel structure being of much greater height adjacent said hand hold structure than laterally thereof to give said third receptacle twice the width of said first and second receptacles, (b) placing at least one container of said first size in one of said first and second receptacles, (c) placing a container of said second size in said third receptacle, and (d) carrying said carrier.

13. A method of distributing food in containers including containers of a first size and a second size much greater than said first size, (a) providing a carrier comprising a vertical support panel structure having a hand-hold structure, first, second and third foldable container structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, in which each of said receptacles includes at least one rectangular bottom structure formed of four flanges, each hinged to the bottom of one of said side walls, flanges at opposite corners of said rectangular bottom structure being attached to one another and foldable along diagonal lines, and one of said flanges covering the entirety of said bottom structure.

14. A method as in claim 13 including (e) providing a further receptacle with means for mounting it on said vertical support panel above said first and second receptacles, (f) placing additional solid food items in said further receptacle, (g) mounting said further receptacle on said vertical support structure before said carrying step.

15. A method of distributing food in containers including containers of a first size and a second size much greater than said first size, (a) providing a carrier comprising a vertical support panel structure having a hand-hold structure, first, second and third foldable container structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, (b) providing a further receptacle with means for mounting it on said vertical support panel above said first and second receptacles, (c) placing at least one container of said first size in one of said first and second receptacles, (d) placing a container of said second size in said third receptacle, (e) placing additional solid food items in said further receptacle, (f) mounting said further receptacle on said vertical support structure, and (g) carrying said carrier, and including the step of heating said solid food items before said mounting step.

16. A method of distributing food in containers including containers of a first size and a second size much greater than said first size, (a) providing a carrier comprising a vertical support panel structure having a hand-hold structure, first, second and third foldable container structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, (b) placing at least one container of said first size in one of said first and second containers, (c) placing a container of said second size in said third receptacle, (d) carrying said carrier, in which said receptacles have bottom structures with flanges shaped to bear against at least one side wall of said carrier, and using said flanges to prop said carrier open while it is being loaded.

17. A method as in claim 13 in which said container of said second size contains a food selected from the group consisting of fried chicken, cooked meat, take-out foods, and popcorn, and said container of said first size contains a liquid beverage.

18. A method of distributing food in containers including containers of a first size and a second size much greater than said first size, providing a carrier comprising a vertical support panel structure having a hand-hold structure, first, second and third foldable receptacle structures secured to said vertical support panel structure and unfoldable to form first, second and third receptacles, said first and second receptacles being located on opposite sides of said panel structure, said first and second receptacles comprising a pair of compartments having side walls including a portion of said support panel structure and side wall panels extending outwardly from said support panel structure in a first direction, said third receptacle extending laterally away from said first and second receptacles in a direction transverse to said first direction, and a wall structure separating said third receptacle from said first and second receptacles, said side wall panels including two sets of panels, each comprising three panels secured together in series along fold lines, each set being secured at its ends to said vertical support panel structure, each of said panels having an upper and a lower edge, an automatically-opening bottom structure comprising selectively interconnected flanges extending from said lower edge of each of said panels for each of said two sets of panels, said side wall panels forming side walls of said first, second and third receptacles, said bottom structures forming bottom walls for said first, second and third receptacles, said vertical support panel structure being of much greater height adjacent said hand hold structure than laterally thereof to give said third receptacle twice the width of said first and second receptacles, (b) placing at least one container of said first size in one of said first and second receptacles, (c) Utilizing said third receptacle as said container of said second size to hold food items, and (d) carrying said carrier using said hand-hold.

19. A method as in claim 18 in which said food items in said third receptacle are selected from the group consisting of popcorn, fried chicken, cooked meats, nachos, hamburgers, hot dogs and other take-out foods, and said container of said first size contains a liquid beverage.

* * * * *